United States Patent [19]

Tannerstål

[11] 4,301,844

[45] Nov. 24, 1981

[54] METHOD AND CHIP-MANUFACTURING EDGING-MILL FOR EDGING BOARD

[75] Inventor: Harding Tannerstål, Söderhamn, Sweden

[73] Assignee: AB A. K. Eriksson, Mariannelund, Sweden

[21] Appl. No.: 132,342

[22] Filed: Mar. 20, 1980

[30] Foreign Application Priority Data

Mar. 27, 1979 [SE] Sweden ..... 7902745

[51] Int. Cl.[3] ..... B27C 9/00

[52] U.S. Cl. ..... 144/3 R; 144/326 R

[58] Field of Search ..... 144/1 R, 3 R, 39, 162 R, 144/172, 174, 323, 326 R

[56] References Cited

U.S. PATENT DOCUMENTS

| | | | |
|---|---|---|---|
| 3,552,457 | 1/1971 | Bos | 144/326 R |
| 3,692,074 | 9/1972 | Nilsson | 144/326 R |
| 3,880,215 | 4/1975 | Mallery | 144/39 |

*Primary Examiner*—W. D. Bray

*Attorney, Agent, or Firm*—Sughrue, Mion, Zinn, Macpeak and Seas

[57] ABSTRACT

In a method of edging boards and of cutting the wane edge of the board into chip form in connection therewith, there is used an edging-mill (2) having a circular sawblade (3) which separates the wane from the board (1) in the form of a so-called rib (1*a*). Located downstream of the circular sawblade (3) in the feed direction of the board is a chipping module having a cylindrical milling head (15) which is provided with cutters and which is intended to reduce the rib (1*a*) to chip form. For the purpose of feeding and guiding the board, there is provided between the circular sawblade and the milling head at least one upper and one lower feeding and guiding roller in addition to infeed rollers and outfeed rollers which are located in the feed direction upstream of the circular sawblade and downstream of the milling head respectively.

10 Claims, 1 Drawing Figure

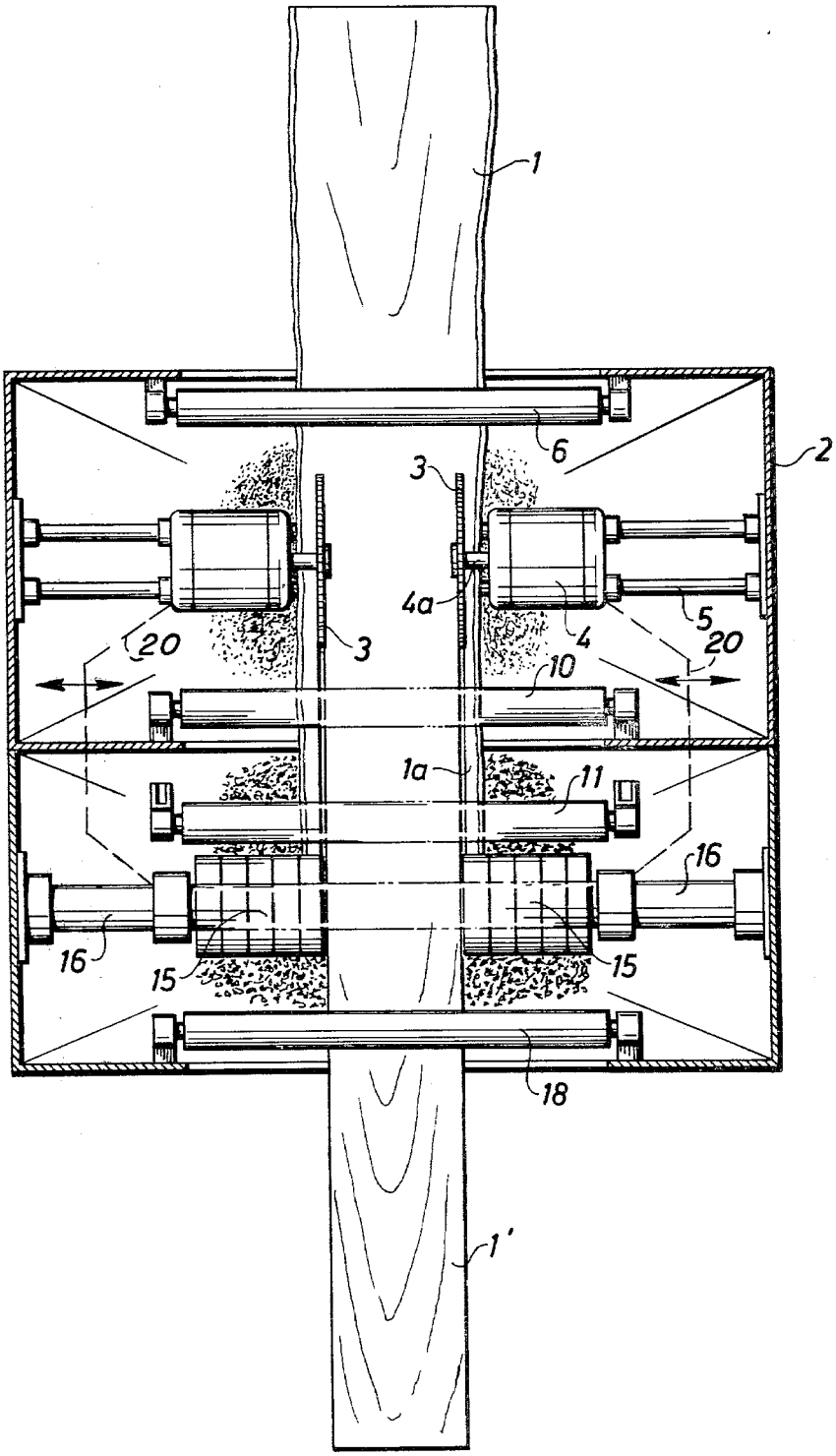
1
2
3
6
4a
5
4
20
3
20
10
1a
11
16
16
15
15
18
1'

METHOD AND CHIP-MANUFACTURING EDGING-MILL FOR EDGING BOARD

The present invention relates to a method of edging a board and in connection therewith of cutting the wane of the board into chip form, in which method the unedged board is fed past a circular saw blade, which separates the wane from the board to form a so-called rib.

Many differing methods and apparatus are known for edging board. The most common of these apparatus is the so-called saw edging-mill, in which two conventional circular saws are arranged to cut the wanes from board to form ribs.

Other types of chip-manufacturing edging-mills comprise two mutually opposite saw blades whose drive shafts have arranged thereon cylindrical milling heads provided with cutters.

Another type of chip-manufacturing edging-mill comprises two mutually opposite reducing discs having angularly oriented cutters. Alternatively, the reducing disc may have sawing segments mounted thereon, there being obtained an arrangement which corresponds to the aforementioned edging-mill having mutually opposing sawblades and cylindrical milling heads on the drive shafts of said blades.

A further known chip-manufacturing edging-mill comprises vertically mounted cylindrical cutting heads having cutters arranged over the outer cylindrical surface thereof.

All of the aforementioned chip-manufacturing edging-mills are encumbered with disadvantages of a more or less serious nature. Thus, in the case of an edging-mill having milling heads provided with circular sawblades, the chip-cutting operation is liable to affect the sawing operation in a manner such that the edged board obtains a crooked and uneven shape.

An edging-mill in which the removed edge strip is cut into chips and which has mutually opposing reducing discs provided with powerful, angularly oriented chippers is liable to rupture the edges of the board and to cause cracks to be formed therein, especially in the case of thin board. Edging-mills having vertically mounted cylindrical cutter heads result in chips of unsuitable shape, so-called comma chips, and a board having a wavy surface structure.

The remaining types of chip-manufacturing edging-mills produce chips of uneven size, with a large percentage of so-called pin chips which are difficult to use.

A further serious disadvantage with milling heads provided with circular saws or saw segments is that so-called complete zero reduction is not possible. This means that with this type of chip-manufacturing edging-mill it is not possible to reduce the whole of the board to chips, which is sometimes desirable.

A chip-manufacturing edging-mill is also known in which the wanes of a board are cut into chip form while being progressively fed to the chippers. The chippers of this known mill are located closely adjacent the circular sawblade, and consequently the mill has some of the disadvantages of the mills earlier discussed.

The object of the present invention is to provide a chip-manufacturing edging-mill in which the aforementioned disadvantages and other disadvantages encountered with known board-edging methods, are avoided, while providing an improved and simplified method of edging boards.

In its widest aspect the method according to the invention is characterized mainly in that the rib being separated from the board by said mill, is moved into contact with a chipping module as the board advances while the trailing end of the rib remains joined to the board, said module being mounted in the feed direction downstream of the saw and being arranged to reduce the rib to chip form.

When applying the method according to the invention, the two operations of edging and chip cutting take place independently of each other, so as not to disturb one another. In this way, the important advantage is obtained whereby sawing of the board results in a straight edge of good surface quality. The prime reason for this is that the rib is chipped at one end thereof while the other end still forms part of the board and is thereby positively held, so that the rib is accurately fed towards the chip pins module at exactly the same speed as the board is fed to the saw. The saw cut located between the board and the rib, the width of which cut depends upon the thickness of the sawblade, ensures complete and effective chipping of the rib to chip form, without risk of the cutters adjacent the board and mounted on the milling head damaging said board. Because a separate, effective and uninterrupted chip-cutting operation is effected, the final result is and edged board of high quality, and a high and uniform chip quality. Further, division of the two operations enables a sawblade and/or chipping module to be readily replaced when necessary, for example when the blade and/or module become worn, or when production conditions change. It will be understood that this implies an important advantage with respect to known apparatus, which require sawblade and milling head to be changed simultaneously.

In practice, the end of the chipping module facing the edged board is preferably maintained at a distance from the board which is less than the width of the saw cut produced by the blade.

In this way complete chipping of the rib is ensured, at the same time as the risk of damaging the edged board is reduced, in accordance with the aforegoing.

In accordance with a preferred embodiment of the invention, the board is advanced and/or guided by means of at least one upper and one lower roller journalled between the sawblade and the chipping module, said rollers being particularly operative in advancing and guiding the rib towards the chipping module when the sawblade separates the whole of the wane from said board after having reached the end thereof.

Thus, the apparatus allows the whole of the rib to be cut into chip form, this cutting action being permitted by the provision of said rollers despite the fact that the rib when the saw reaches the trailing end of the board is completely separated therefrom, such that said board is not able to assist in guiding and holding the rib as the board is advanced.

In accordance with one embodiment of the invention, the sawblade and the chipping module are connected to each other either directly or indirectly, so that said blade and said module can be simultaneously adjusted in one single operation, if so desired.

The invention also relates to a chip-manufacturing edging-mill for edging board and, in conjunction therewith, for cutting the wane of the board into chip form, the essential characterizing features of the edging-mill being disclosed in the accompanying claims.

Suitably, a chip-manufacturing edging-mill according to the invention, comprises two mutually opposing sawblades and two mutually opposing chipping modules in an arrangement which is conveniently symmetrical around the longitudinal axis of the board being machined in the edging-mill.

So that the invention will be more readily understood and further features thereof made apparent, an exemplary embodiment of the invention will now be described with reference to the accompanying drawing, the single FIGURE of which is a plan view of a chip-manufacturing edging-mill according to the invention.

Shown in the FIGURE is a board 1 which is to be edged in a combined circular-saw mill and chip-manufacturing edging-mill 2. The saw section of the edging-mill comprises two mutually opposite circular sawblades 3, each of which is mounted on the output shaft 4*a* of a respective drive motor 4. Each of the motors is axially displaceably mounted on two mutually parallel tubular guides 5.

The infeed part of the edging-mill includes at least one upper infeed roller 6 and at least one lower roller (not shown), of which rollers at least one is driven. In practice there is preferably used at least two lower and one upper infeed roller 6.

Downstream of the sawblades 3 there is arranged at least one upper and one lower further-conveying roller 10 and 11, respectively, the purpose of which is primarily to ensure that the wanes 1*a* separated from the board by means of the circular sawblades 3 are fed towards a subsequent chipping module comprising two mutually opposite cylindrical milling heads 15 provided with cutters, said wanes 1*a* being cut by the blades 3 to form so-called ribs, and said ribs being chipped while the trailing ends of the ribs are still joined to the board. The milling heads are adjustably mounted on shafts 16.

A practically preferred embodiment of the invention is provided between the circular sawblades 3 and the milling heads 15 with one upper and two lower rollers 10, 11, which assist in drawing the board with the separated rib 1*a* out from the circular sawblades and to advance and guide the rib towards the milling heads 15, which reduce the rib to chip form. The feeding and guiding operation effected by the rollers 10, 11 is of particular significance when the sawblades have reached the trailing edge of the board, since the rib 1*a* is then completely separated from the board, i.e. the aforementioned end of said rib is no longer attached to the board. The two lower rollers can be exchanged for a plurality of separate rollers.

Downstream of the chipping module there is arranged at least one upper outfeed roller 18 and one lower outfeed roller (not shown), which assist in feeding the edged board 1' from the edging mill. In practice there is suitably used two lower and one upper outfeed roller. The distance between the blades 3 and the milling heads 15 may lie between approximately 20 cms and 1.5 m. In an embodiment preferred in practice, the distance is about 1 meter.

The saw and milling units may optionally be joined together in some suitable way, as schematically shown by broken lines 20, so that said units can be simultaneously adjusted in dependence of the width of the board being cut. It is preferred in many cases, however, that the two units are capable of being set separately, independently of one another.

If the circular sawblades 3 have a thickness of 4 mm, this means that the saw cut produced thereby between the major part of the board and the rib or wane edge 1*a* thereof will be of at least that thickness. The distance between the end edge of the milling head 15 facing the board and the board can be, in this case, between 0 and 4 mm, suitably about 2 mm, whereat it is ensured that the rib will be completely cut to chip form whilst eliminating the risk of damage to the side edges of the board. Thus, the thickness of the circular saws 3 is determinative for the clearance which is available. Alternatively, the milling heads may be so designed that the side flanks of the cutters are located about 0.5 mm within the lateral planes of respective milling heads. In this way damage to the side edges of the board is avoided when the board is guided towards the side planes of the milling head.

I claim:

1. A method of edging boards and reducing wane severed therefrom to chip form, comprising: feeding a board to a circular sawblade to separate the wane from said board in the form of a rib connected to the board just in advance of the sawblade in the direction of feed, and advancing said board to progressively bring said rib into cutting engagement with chipping means downstream from said sawblade as said rib is formed.

2. A method according to claim 1, further comprising holding the end of the chipping means facing the edged board spaced from the board at a distance which is less than the width of the cut produced by the sawblade.

3. A method according to claim 2, further comprising advancing and guiding said board by upper and lower means rotatably mounted between the sawblade and the chipping module, said means contributing particularly to feeding and guiding the rib towards the chipping means when the whole of the wane has been separated from said board.

4. A method according to claim 1, in which the sawblade and chipping means are joined together for simultaneous setting, and adjusting the sawblade and chipping means simultaneously in dependence upon the width of the board and its wane edge, respectively.

5. A chip-manufacturing edging-mill for edging board and cutting a wane edge thereof to chip form, comprising: a circular sawblade for separating the wane edge from the board in the form of a rib connected to the board just in advance of the sawblade in the direction of feed; chipping means disposed downstream of the circular sawblade in the feed direction of the board, said chipping means including a milling head in the form of a cylinder provided with cutters, and means for advancing and controlling the board to feed it through said sawblade and to progressively bring said rib into cutting engagement with said chipping means.

6. A mill according to claim 5, wherein the distance between the circular sawblade and the chipping means is between about 20 cms and 1.5 m, and preferably about 1 m.

7. A mill according to claim 5, wherein the distance between the edged board and the end of the chipping means facing the board is less than the width of the saw cut produced by the sawblade.

8. A mill according to claim 5, wherein at least one upper and one lower feeding and guiding roller is arranged between the circular sawblade and the chipping module.

9. A mill according to claim 5, wherein the sawblade and the chipping means are connected together so that the sawblade and the milling head can be adjusted simultaneously.

10. A mill according to claim 5, wherein said mill comprises two mutually opposing sawblades and two mutually opposing milling heads in an arrangement which is substantially symmetrical about the longitudinal axis of the treated board.

* * * * *